US009789615B2

(12) United States Patent
Tsai

(10) Patent No.: US 9,789,615 B2
(45) Date of Patent: Oct. 17, 2017

(54) CUTTER

(71) Applicant: HONG JIN INDUSTRY CO., LTD., Taichung (TW)

(72) Inventor: Chung Tsai, Taichung (TW)

(73) Assignee: HONG JIN INDUSTRY CO., LTD., Taichung (TW)

( * ) Notice: Subject to any disclaimer, the term of this patent is extended or adjusted under 35 U.S.C. 154(b) by 195 days.

(21) Appl. No.: 14/921,959

(22) Filed: Oct. 23, 2015

(65) Prior Publication Data

US 2017/0113364 A1 Apr. 27, 2017

(51) Int. Cl.

| | |
|---|---|
| ***B26B 17/00*** | (2006.01) |
| ***B26B 17/02*** | (2006.01) |
| ***B25B 7/12*** | (2006.01) |
| ***B25B 7/02*** | (2006.01) |
| ***B25B 7/00*** | (2006.01) |
| ***B25B 7/14*** | (2006.01) |
| *B26B 29/06* | (2006.01) |

(52) U.S. Cl.

CPC ..... *B26B 17/00* (2013.01); *B25B 7/00* (2013.01); *B25B 7/02* (2013.01); *B25B 7/12* (2013.01); *B25B 7/14* (2013.01); *B26B 17/02* (2013.01); *B26B 29/06* (2013.01)

(58) Field of Classification Search

CPC ..... B26B 29/06; B26B 17/00; B26B 17/02; B25B 7/00; B25B 7/02; B25B 7/04; B25B 7/12; B25B 7/123; B25B 7/14; B25B 7/16; B25B 7/18

See application file for complete search history.

(56) References Cited

U.S. PATENT DOCUMENTS 4,106,195 A * 8/1978 Berg ..... B26B 17/00 30/178
4,144,737 A * 3/1979 Izraeli ..... B25B 7/18 72/409.11
5,673,487 A * 10/1997 Malagnoux ..... B26B 17/00 30/179
5,913,575 A * 6/1999 Lai ..... B26B 17/00 30/178

(Continued)

FOREIGN PATENT DOCUMENTS

DE 4313996 C1 * 7/1994 ..... B25B 7/00
DE 20005232 U1 * 5/2000 ..... A01G 3/02

(Continued)

OTHER PUBLICATIONS

English Translation of DE20005232.*

*Primary Examiner* — Jennifer Swinney

(57) ABSTRACT

A cutter includes two handles, a blade, a cutting board, an angle holder, two screws, a spring-biased lock and a releasing element. The cutting board is supported on the first handle. The blade is connected to the second handle. The angle holder includes teeth and a cutout. The angle holder is attached to the first handle by the screws. The releasing element is pivotally connected to the first handle and includes a slot. The spring-biased lock is pivotally connected to the first handle. The spring-biased lock is allowed to engage with the teeth or enter the cutout when an end of the slot is placed against one of the screws. The spring-biased lock is removed from the teeth and the cutout when another end of the slot is placed against the screw.

10 Claims, 6 Drawing Sheets

(56) References Cited

U.S. PATENT DOCUMENTS

| | | | | | |
|---|---|---|---|---|---|
| 6,161,455 | A * | 12/2000 | Ping | B25B 7/12 | 81/358 |
| 6,308,421 | B1 * | 10/2001 | Wang | B23D 29/02 | 30/178 |
| 6,474,130 | B2 * | 11/2002 | Battenfeld | B25B 7/00 | 72/409.07 |
| 6,640,441 | B1 * | 11/2003 | Huang | B23D 21/06 | 30/179 |
| 6,757,978 | B1 * | 7/2004 | Huang | B26B 17/00 | 30/178 |
| 2005/0198833 | A1 * | 9/2005 | Lin | B23D 15/002 | 30/131 |
| 2014/0331825 | A1 * | 11/2014 | Khristyuchenko | | |

FOREIGN PATENT DOCUMENTS

| | | | | | |
|---|---|---|---|---|---|
| EP | 0241798 | A2 * | 10/1987 | B25B 7/06 | |
| GB | 1191341 | A * | 5/1970 | B25B 7/10 | |
| WO | WO 03086712 | A1 * | 10/2003 | B25B 7/10 | |

* cited by examiner

CUTTER

BACKGROUND OF INVENTION

1. Field of Invention

The present invention relates to a cutter for cutting a sheet of wood or melamine and, more particularly, to a cutter for precisely and smoothly cutting a sheet of wood or melamine into a desired shape with a corner of a desired angle.

2. Related Prior Art

A cutter is used to cut a sheet of wood or melamine into a desired shape with a corner of a desired angle. Such a cutter can be a pair of scissors or a saw.

However, the use of conventional cutters to cut the sheet of wood or melamine is conducted in a step-by-step manner if the sheet of wood or melamine is thick. This is because a user inevitably feels stress and fatigue in his or her hand and has to pause from time to time during the operation. However, conventional cutters do not include any device to hold the sheet of wood or melamine in position relative to the blade and the cutting board in such a pause. Hence, the user has to align the sheet of wood or melamine to the blade and the cutting board again after such a pause, and this is inconvenient. Moreover, a stroke of cutting might not be perfectly in line with a following stroke of cutting, and an edge of the sheet of wood or melamine is not perfectly rectilinear. Furthermore, the blade tends to be raised from the sheet of wood or melamine, and the user could easily get cut by the blade.

The present invention is therefore intended to obviate or at least alleviate the problems encountered in prior art.

SUMMARY OF INVENTION

It is an objective of the present invention to provide a cutter for precisely keeping a sheet in position when cutting of the sheet is temporarily stopped.

It is another objective of the present invention to provide a cutter with a blade that is kept in position during cutting of a sheet.

It is another objective of the present invention to provide a cutter with a blade that can easily be released from a cutting board.

To achieve the foregoing objectives, the cutter includes two handles, a blade, a cutting board, an angle holder, two screws, a spring-biased lock and a releasing element. The handles are pivotally connected to each other. The cutting board is supported on the first handle. The blade is connected to the second handle. The angle holder includes teeth at an edge and a cutout near the teeth. The angle holder is attached to the first handle by the screws. The releasing element is pivotally connected to the first handle by the first screw and includes a slot. The spring-biased lock is pivotally connected to the first handle. The spring-biased lock is allowed to engage with the teeth or enter the cutout of the angle holder when the first end of the slot is placed against the second screw. The spring-biased lock is removed from the teeth and the cutout when the second end of the slot is placed against the second screw.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
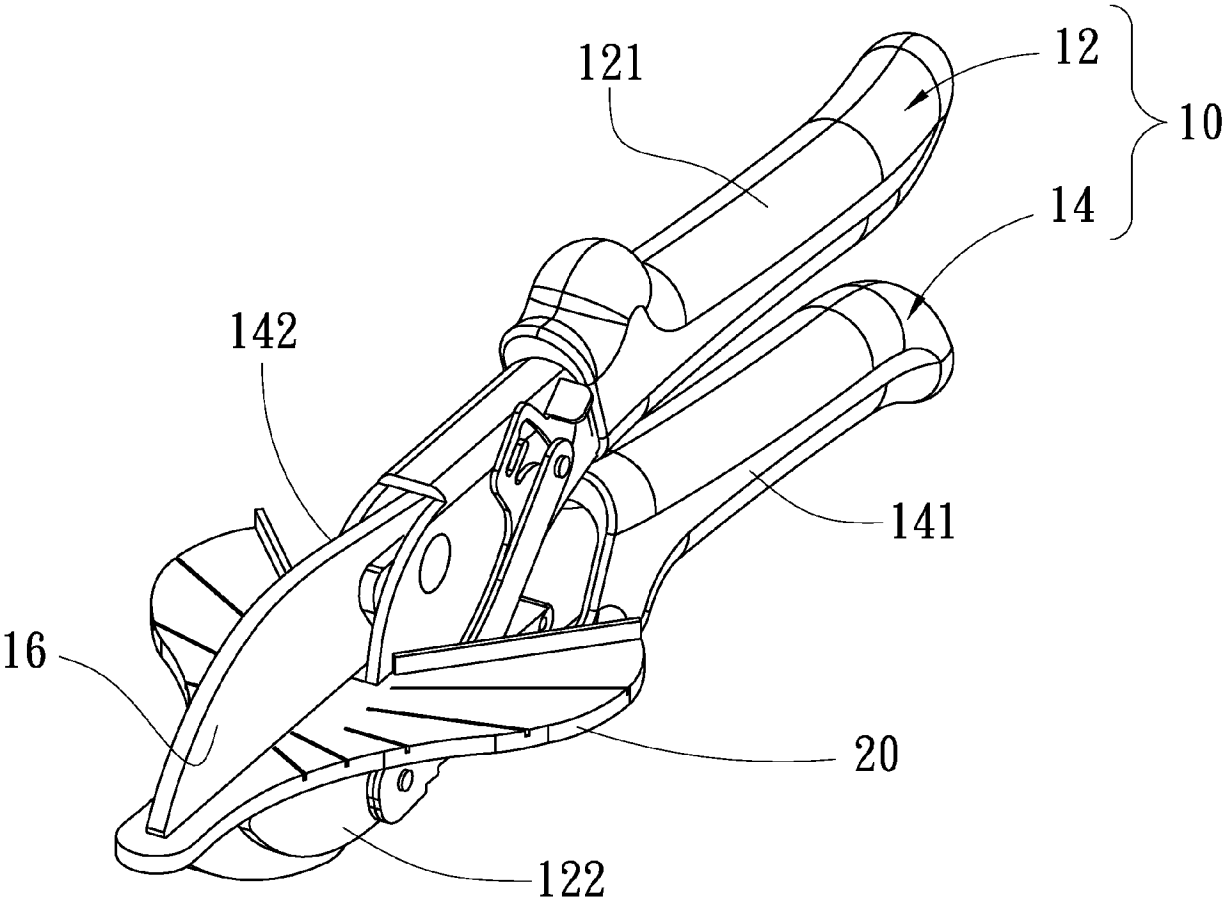
FIG. 1 is a perspective view of a cutter according to the preferred embodiment of the present invention.
Figure 2:
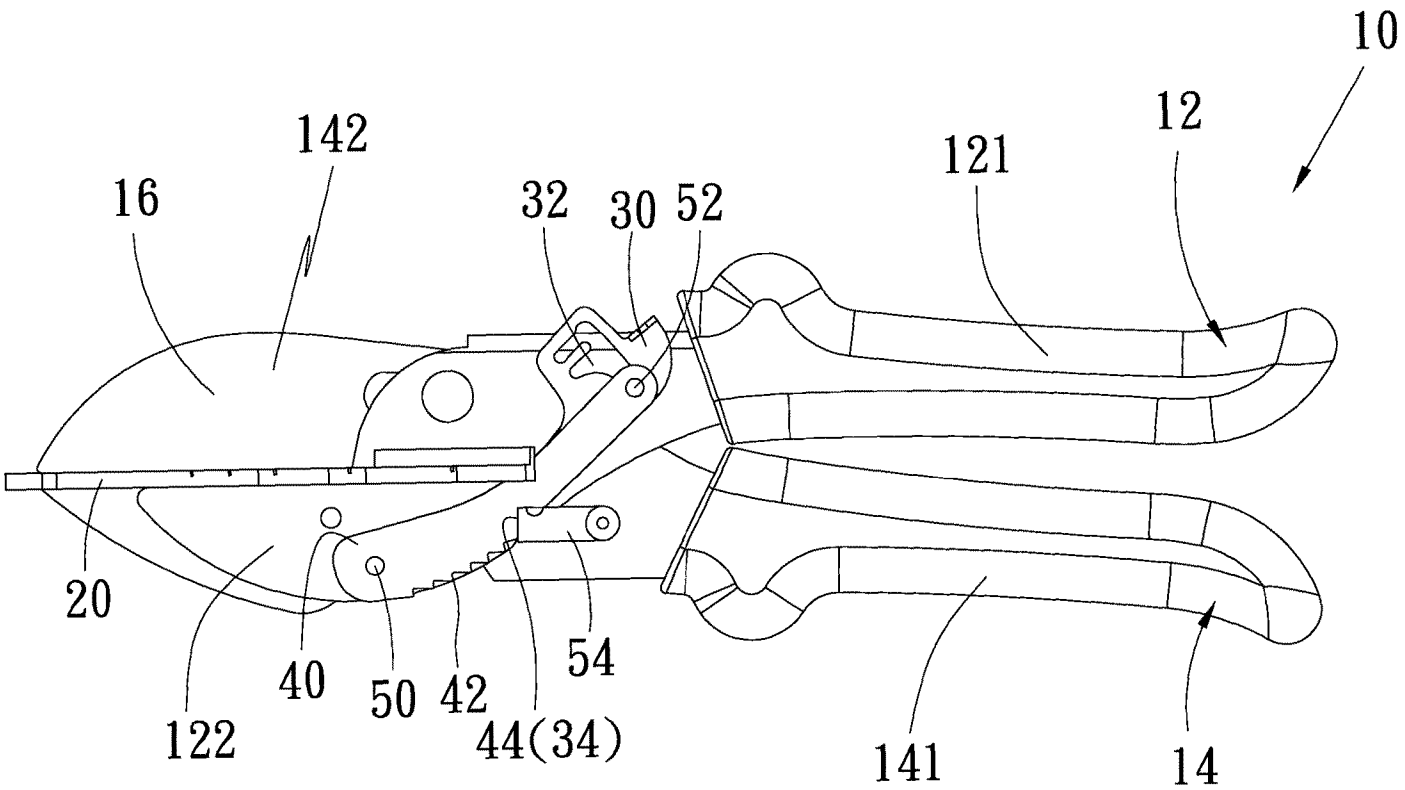
FIG. 2 is a right side view of the cutter shown in FIG. 1.
Figure 3:
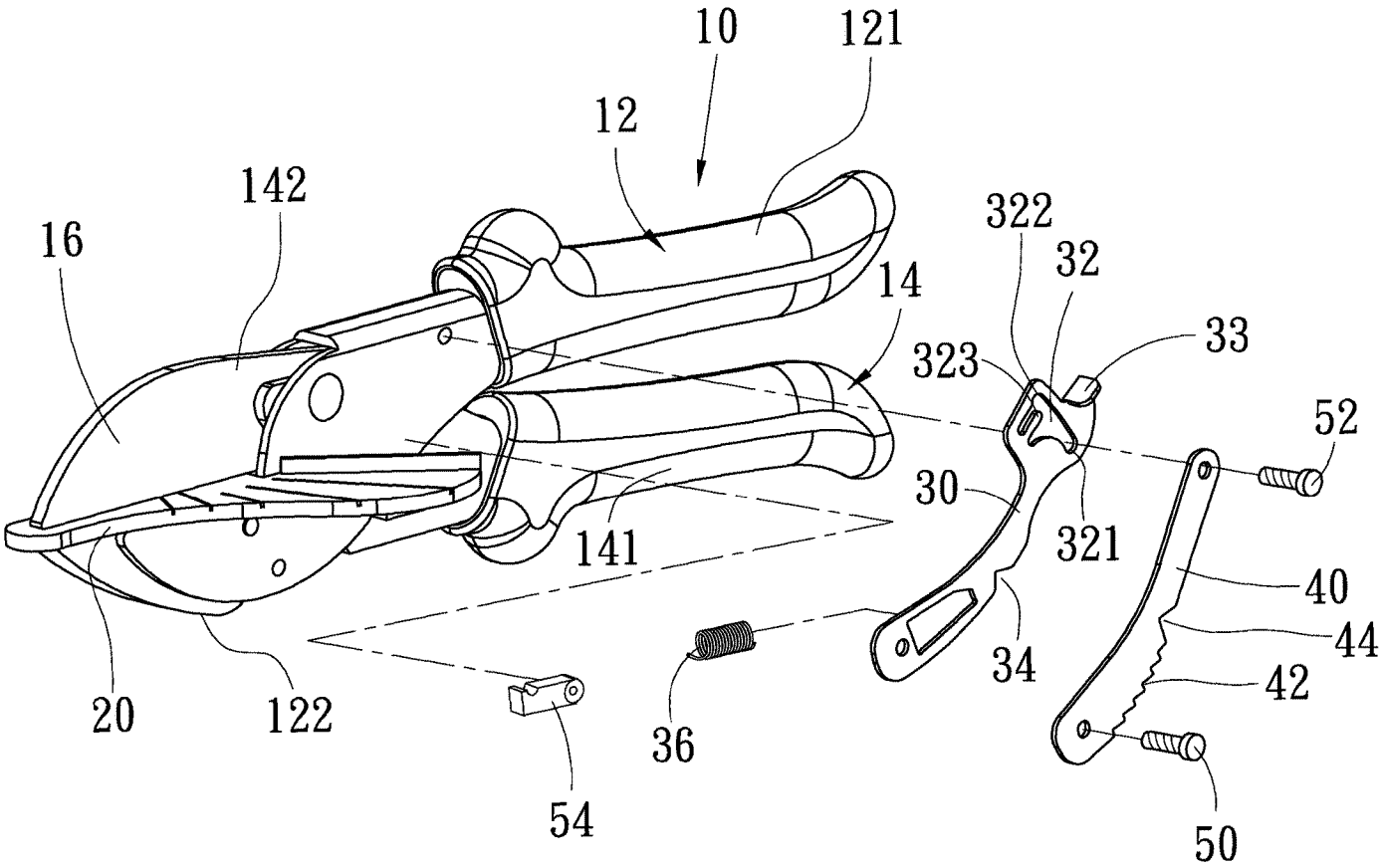
FIG. 3 is an exploded view of the cutter shown in FIG. 1.

Referring to FIGS. 1 through 3, there is a cutter 10 according to the preferred embodiment of the present invention. The cutter 10 includes two handles 12 and 14, a blade 16, a cutting board 20, a releasing element 30, an angle holder 40 and a spring-biased lock 54.

The first handle 12 includes a grip 121 at an end and a jaw 122 at another end. The blade 16 is connected to the jaw 142 of the second handle 14.

The second handle 14 includes a grip 141 at an end and a jaw 142 at another end. The cutting board 20 is supported on the jaw 122 of the first handle 12.

The first handle 12 is pivotally connected to the second handle 14 like in a pair of scissors. A compression spring (not shown) can be provided between the handles 12 and 14 so that they tend to open when they are not squeezed. Accordingly, the blade 16 is away from the cutting board 20, ready to cut a sheet of wood or melamine.

Referring to FIGS. 2 and 3, the angle holder 40 includes an end connected to the jaw 122 of the first handle 12 by a first screw 50 and another end connected to the grip 121 of the first handle 12 by a second screw 52. There is a gap (not numbered) between the angle holder 40 and the first handle 12. The angle holder 40 includes, at an edge, a plurality of teeth 42 for engagement with the spring-biased lock 54 in a manner to be described. There is a cutout 44 in the edge of the angle holder 40, near the teeth 42.

The spring-biased lock 54 includes an end pivotally connected to the jaw 142 of the second handle 14 and a free end that tends to move to the teeth 42 of the angle holder 40. Thus, the free end of the spring-biased lock 54 can selectively be engaged with the teeth 42 of the angle holder 40 or the cutout 44 referring to FIGS. 4 and 5.

The releasing element 30 includes a button 33 formed at an end, a slot 32 near the button 33, an elastic restrainer 323 transversely extending in the slot 32, and a cutout 34 corresponding to the cutout 44 of the angle holder 40. The slot 32 includes two ends 321 and 322. The elastic restrainer 323 is located near the second end 322 of the slot 32.

The releasing element 30 is located in the gap between the first handle 12 and the angle holder 40. The releasing element 30 is movably connected to the angle holder 40 by the first screw 50 at another end. The slot 32 receives the second screw 52, which is connected to the angle holder 40. Thus, the releasing element 30 can be pivoted relative to the second screw 52 and the angle holder 40. The second screw 52 can selectively be abutted against the end 321 or 322 of the slot 32.

A spring 36 is arranged between the jaw 122 of the first handle 12 and the releasing element 30 so that the spring 36 tends to abut the first end 321 of the slot 32 of the releasing element 30 against the second screw 52, which is connected to the angle holder 40. The cutout 34 of the releasing element 30 is aligned to the cutout 44 of the angle holder 40.

Now, the edge of the releasing element 30 does not extend beyond the teeth 42 of the angle holder 40. Accordingly, the spring-biased lock 54 can be engaged with the teeth 42 of the angle holder 40 or inserted in the cutout 44 of the angle holder 40 and the cutout 34 of the releasing element 30 referring to FIGS. 4 and 5.

On the contrary, the releasing element 30 can be operated to abut the second end 322 of the slot 32 against the second screw 52, which is connected to the angle holder 40. Now, the edge of the releasing element 30 extends beyond the teeth 42 and the cutout 44 of the angle holder 40. Hence, the edge of the releasing element 30 can disengage the spring-biased lock 54 from the teeth 42 of the angle holder 40 or the cutout 44 referring to FIG. 6. Accordingly, the handles 12 and 14 are opened, and the cutter 10 is ready to cut a sheet of wood or melamine. The teeth 42 of the angle holder 40 are in the vicinity of the spring-biased lock 54 referring to FIG. 4.

Figure 4:
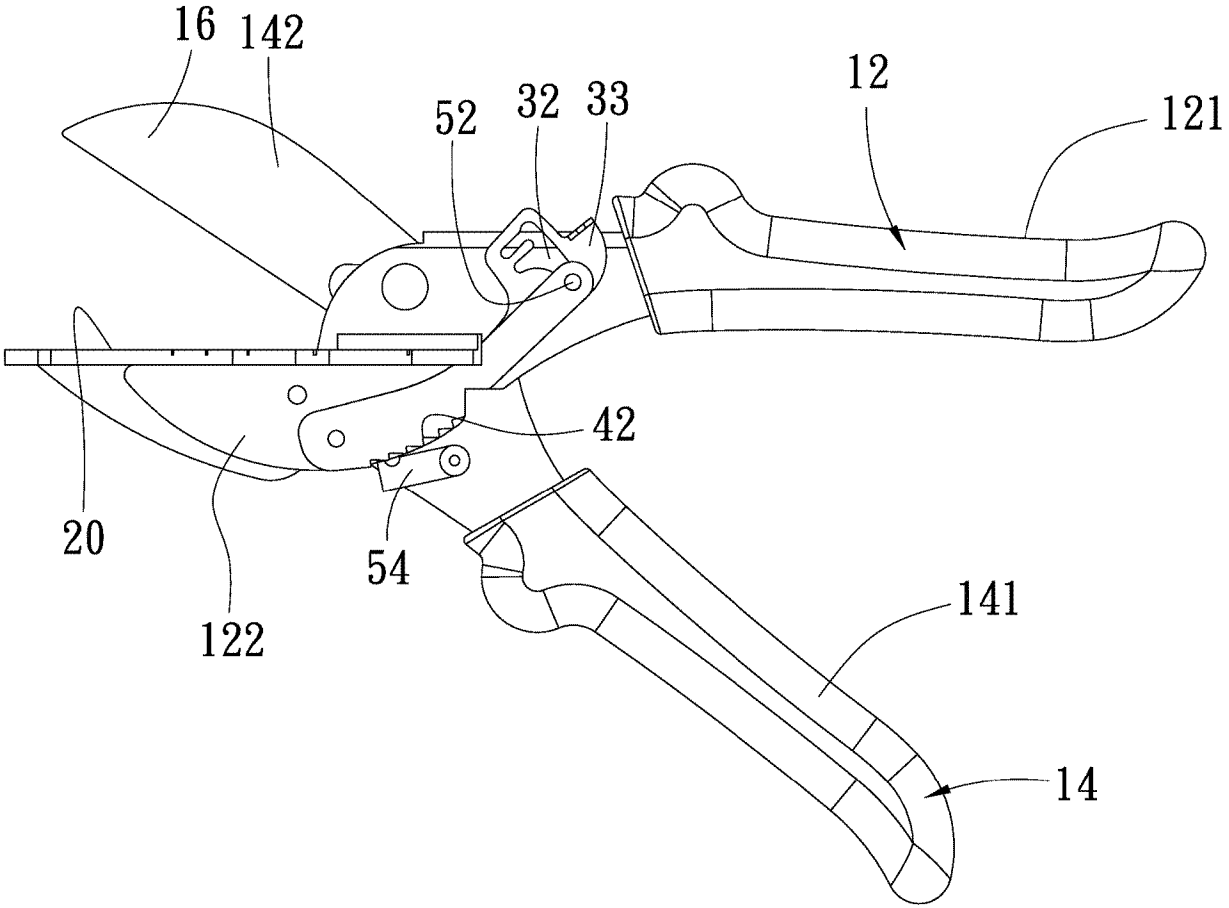
FIG. 4 is a right side view of the cutter in another position than shown in FIG. 2.

Referring to FIG. 4, in the beginning of a cutting operation, a user presses the button 33 of the releasing element 30 to bring the second end of the releasing element 30 and the second end 322 toward the second screw 52. Thus, the handles 12 and 14 are opened, and the blade 16 is away from the cutting board 20. That is, between the blade 16 and the cutting board 20, there is a gap to receive a sheet of wood or melamine. Hence, the cutter 10 is ready to cut the sheet.

Then, the user can pivot the grip 121 of the first handle 12 toward the grip 141 of the second handle 14. Thus, the blade 16 is pivoted toward the cutting board 20 to cut the sheet. As the closing of the handles 12 and 14 goes on, the blade 16 gets closer to the cutting board 20 while the spring-biased lock 54 rattles beneath the teeth 42.

Figure 5:
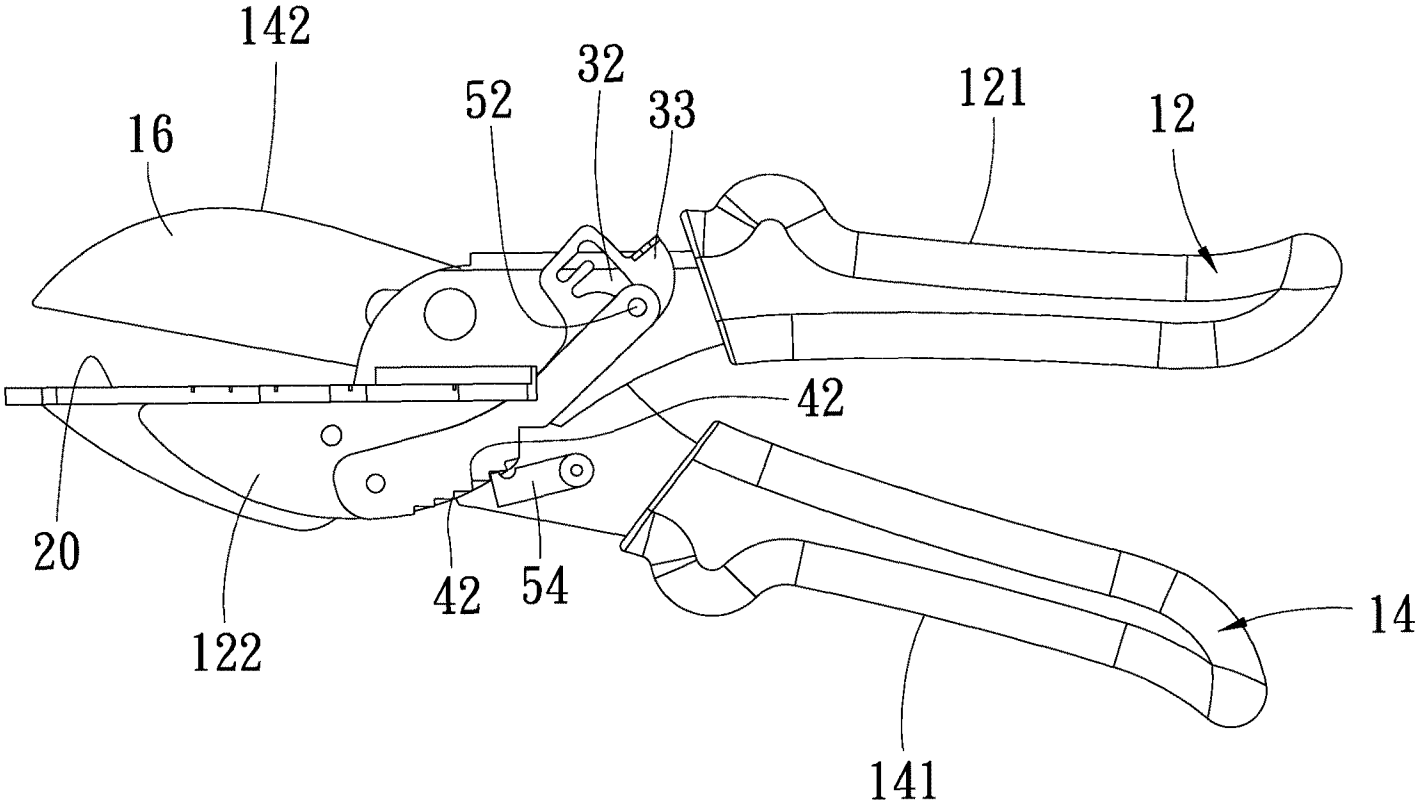
FIG. 5 is a right side view of the cutter in another position than shown in FIG. 4.

Referring to FIG. 5, the user can temporally release the handles 12 and 14 and relax for a while before he or she continues the cutting operation. The spring-biased lock 54 is automatically engaged with the teeth 42, and the first handle 12 is kept in a position relative to the second handle 14. During the pause, the sheet is kept in position relative to the cutting board 20 and the blade 16. The blade 16 is kept on the sheet, and the odds of the user getting cut by the blade 16 are low. Moreover, the user does not have to align the sheet to the blade 16 and the cutting board 20 again before he or she continues the cutting operation after the pause, and this is convenient. Hence, an edge of the sheet resulting from the entire cutting operation is rendered perfectly rectilinear although the cutting operation is conducted in several discrete phases.

Referring to FIG. 2, the user can operate the releasing element 30 to align the cutout 34 to the cutout 44 again. Thus, the spring-biased lock 54 can be inserted in the cutout 34 and the cutout 44 again. Hence, the handles 12 and 14 are closed.

Figure 6:
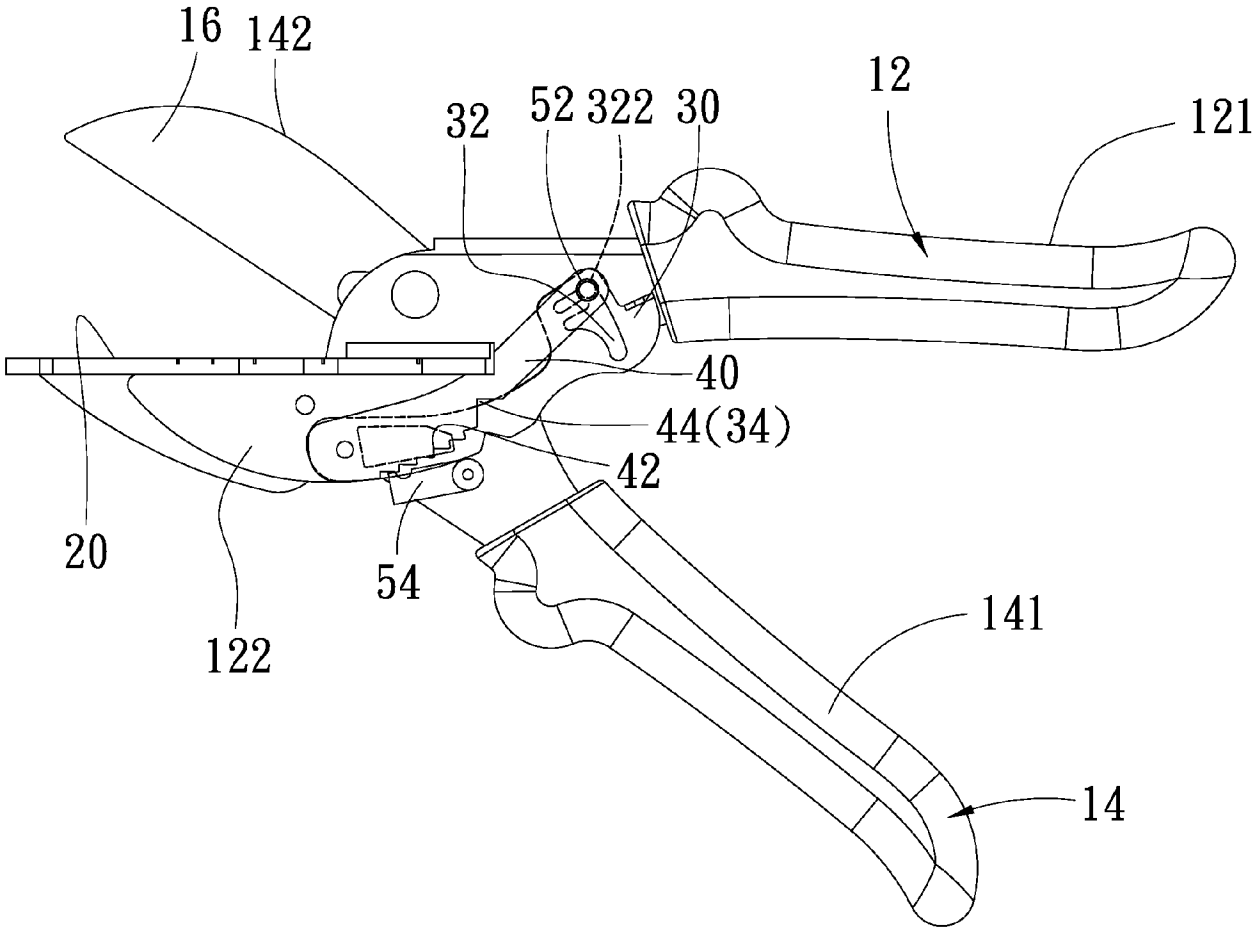
FIG. 6 is a right side view of the cutter in another position than shown in FIG. 5.

Referring to FIG. 6, the button 33 is pushed to pivot the releasing element 30 so that the second end 322 of the slot 32 is moved toward the second screw 52 and that the spring-biased lock 54 is remove from the teeth 42 and the aligned cutouts 34 and 44. Accordingly, the handles 12 and 14 can be opened. That is, the releasing element 30 in a releasing mode. There is no need for the user to operate the spring-biased lock 54, which is small and short. Hence, the operation of the cutter 10 is convenient. Furthermore, the user is protected from the spring-biased lock 54 and the angle holder 40. The operation of the cutter 10 is safe.

Moreover, the pivoting of the releasing element 30 can be continued to move the elastic restrainer 323 past the second screw 52. The second end 322 of the slot 32 is placed against a side of the second screw 52 as the elastic restrainer 323 of the releasing element 30 is placed against another side of the second screw 52. The elastic restrainer 323 abuts against the second screw 52 to cause the releasing element 30 to keep the teeth 42 and the cutout 44 from the spring-biased lock 54 even when the handles 12 and 14 are released. That is, the releasing element 30 is kept in the releasing mode. Now, the cutter 10 is in a mode particularly useful for cutting a thin sheet.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cutter comprising:

a first handle;

a second handle pivotally connected to the first handle;

a cutting board supported on the first handle;

a blade connected to the second handle;

an angle holder comprising teeth at an edge and a cutout near the teeth;

a first screw and a second screw for attaching the angle holder to the first handle;

a releasing element pivotally connected to the first handle at a first end by the first screw and at a second end by a slot, receiving the second screw; and a spring-biased lock pivotally connected to the first handle, wherein the spring-biased lock is allowed to engage with the teeth or enter the cutout when a first end of the slot is placed against one of the first screw and second screw, wherein the spring biased lock is removed from the teeth and the cutout when a second end of the slot is placed against the second screw.

2. The cutter according to claim 1, wherein the releasing element comprises a cutout, wherein the releasing element aligns the cutout thereof to the cutout of the angle holder so that the spring-biased lock can be inserted in each aligned cutout.

3. The cutter according to claim 1, wherein the releasing element is located between the first handle and the angle holder.

4. The cutter according to claim 1, wherein the releasing element comprises a button operable to pivot the releasing element.

5. The cutter according to claim 1, wherein the releasing element comprises an elastic restrainer confining the second screw near the second end of the releasing element.

6. The cutter according to claim 1, further comprising a spring for biasing the releasing element so that the first end of the slot is kept against the second screw.

7. The cutter according to claim 1, wherein the first handle comprises a grip formed at an end and a jaw formed at another end.

8. The cutter according to claim 7, wherein the cutting board is supported on the jaw of the first handle.

9. The cutter according to claim 1, wherein the second handle comprises a grip formed at an end and a jaw formed at another end.

10. The cutter according to claim 9, wherein the blade is connected to the jaw of the second handle.

* * * * *